US006511164B1

(12) United States Patent
Bajeux

(10) Patent No.: US 6,511,164 B1
(45) Date of Patent: Jan. 28, 2003

(54) CONTROL SYSTEM FOR SPRAYING ELECTRICALLY CONDUCTIVE LIQUID

(75) Inventor: Paul Bajeux, Chatuzange-le-Goubet (FR)

(73) Assignee: Imaje S. A., Bourg les Valence Cedex (FR)

( * ) Notice: Subject to any disclaimer, the term of this patent is extended or adjusted under 35 U.S.C. 154(b) by 0 days.

(21) Appl. No.: 09/424,403

(22) PCT Filed: Jun. 2, 1998

(86) PCT No.: PCT/FR98/01107

§ 371 (c)(1),
(2), (4) Date: Nov. 22, 1999

(87) PCT Pub. No.: WO98/55315

PCT Pub. Date: Dec. 10, 1998

(30) Foreign Application Priority Data

Jun. 3, 1997 (FR) ..... 97 06799

(51) Int. Cl.[7] ..... B41J 2/07
(52) U.S. Cl. ..... 347/74; 347/75
(58) Field of Search ..... 347/74, 75, 76, 347/77, 78, 82; 239/690, 708

(56) References Cited

U.S. PATENT DOCUMENTS

| | | | | |
|---|---|---|---|---|
| 4,122,458 A | 10/1978 | Paranjpe | | 347/75 |
| 4,138,686 A | 2/1979 | Graf | | 347/75 |
| 4,220,958 A | 9/1980 | Crowley | | 347/75 |
| 4,560,991 A | 12/1985 | Schutrum | | 347/75 |
| 4,658,269 A | 4/1987 | Rezanka | | 347/75 |
| 4,845,512 A | 7/1989 | Arway | | 347/75 |
| 4,928,113 A | 5/1990 | Howell et al. | | 347/76 |
| 5,001,497 A | 3/1991 | Wills et al. | | 347/75 |
| 5,070,341 A | 12/1991 | Wills et al. | | 347/75 |

FOREIGN PATENT DOCUMENTS

| | | | | |
|---|---|---|---|---|
| EP | 153 436 A2 | | 3/1984 | |
| EP | 532 406 A1 | | 9/1992 | |
| EP | 744 291 A2 | | 5/1996 | |
| GB | 2 249 995 A | | 11/1990 | |
| JP | 59031167 A | * | 2/1984 | 347/78 |
| WO | WO 88/01572 | | 3/1988 | |
| WO | WO 94/08792 | | 4/1994 | |
| WO | WO 94/16896 | | 8/1994 | |

OTHER PUBLICATIONS

West,D.L. and Williams,T.H., "Ink Jet Deflection Plate Arrangement", IBM Technical Disclosure Bulletin, vol. 15, No. 2, pp. 476–477, Jul. 1972.*

* cited by examiner

*Primary Examiner*—Lamson Nguyen
(74) *Attorney, Agent, or Firm*—Pearne & Gordon LLP

(57) ABSTRACT

A spraying control system for an electrically conducting liquid (3) emitted in the form of a pressurized jet (4) through at least one nozzle (2). The system contains apparatus for separating the liquid into drops, apparatus for electrically charging the drops and apparatus for applying an electrical deflection field to the charged drops. The system includes a first (8) and a second (6) monolithic element each with a continuous surface, laid out such that the continuous surfaces are facing each other and define a space (5) between them in which the pressurized jet (4) is emitted through the nozzle (2). The elements (6,8) include apparatus for continuously setting up potentials on the continuous surfaces to obtain the electrical charge of the drops and the electrical deflection field. The system also includes electronic control (31 to 36) for the potentials and apparatus for checking the intensity of electrical currents that can circulate on the continuous surfaces.

10 Claims, 4 Drawing Sheets

CONTROL SYSTEM FOR SPRAYING ELECTRICALLY CONDUCTIVE LIQUID

BACKGROUND OF THE INVENTION

This invention relates to a spraying control system for an electrically conducting liquid. This type of system can be used particularly in an inkjet print head using the continuous jet process.

DESCRIPTION OF RELATED ART

In a liquid spraying control system with one or several continuous jets used in inkjet printers, each electrically conducting liquid jet is separated into drops. The drops are electrically charged and their path is then deflected by an electrical field which, depending on the information to be reproduced, deviates each drop either towards an ink recovery gutter, or to the support on which the ink is to be deposited.

In continuous jet printers, the ink is pressurized on the inlet side of a discharge nozzle. A continuous jet is discharged through the outlet from the nozzle. This continuous jet is processed by the liquid spraying control system by means of several devices performing a number of functions. Firstly the jet is separated into drops by a device controlled by a separating signal. At the same time, the drops separating from the continuous jet are electrically charged under the effect of the electrical field set up between the charging electrode and the liquid. They then enter a electrical deflection field generated between two electrodes or deflection plates to be deviated in this electrical field as a function of its value. At the exit from the liquid spraying control system, the ink drops are either recovered to return to the ink supply circuit, or are deposited on the support.

In practice, liquid spraying control systems used on printers have a number of disadvantages. They require that a large number of parts are made and positioned with high precision. These parts are complex and must be separated by "safety" distances and/or shielding and by empty or insulating spaces that separate the functions, unnecessarily extending the path of the drops. Parts performing each function create discontinuous surfaces that cause internal local increases in the electrical field that facilitate electrical discharges. These surfaces are also difficult to clean when material residues are eliminated inside the print head. Since the parts performing each function are supported by insulators, their surfaces may become electrically charged in a variable manner and parasite electrical fields are then applied to the liquid. The result is random deviations of the drops. The electrical voltages involved with this type of control system may be as high as 10 kV.

In the current state of the art, drop deflections are frequently used in space at atmospheric pressure. Since the drops are electrically charged beforehand, a force is applied to them proportional to their charge and to the electrical field. This electrical field is obtained by two conducting plates close to the drop trajectory and to which a potential difference is applied. Document GB-A-2 249 995 proposes that one of the deflection plates could be coated with a dielectric coating to prevent accidental electrostatic discharges and/or to adapt the potential of the free space through which the drops pass. According to document U.S. Pat. No. 4,845,512, this dielectric coating may have a permanent electrical polarization (electret) in order to generate the electrical potential, or part of it. This would take place without any electrical connections. In this environment, the sprayed liquid and the presence of gas to which fairly intense electrical fields are applied create material particles and charges moving in free space. Spraying and the electrical forces drive these free elements (particles and charges) onto the walls located around the jet. In particular, these elements collect on the free surface of the insulation to which the electrical field is applied and are attracted by opposite charges. Thus, they compensate the charges of the electret or the electrode previously coated with insulation. Consequently, the useful field in the free space gradually reduces as the electrical field increases in the dielectric. The efficiency of the deflection reduces as a function of the reduction in the electrical field in free space.

Document WO 94/16896 recommends the use of electrically conducting plastic material to make a spraying control system for an electrically conducting liquid. This can reduce the cost, the number of ancillary parts such as shielding, and can simplify wiring. The plastic electrically conducting material also picks up the electrical charges. This plastic material may be made of polyacetylene which is an intrinsic conducting polymer. Preferably, it would be a plastic resin such as Nylon®, polyester, acetal containing conducting fibers (carbon, stainless steel) coated with nickel. The heterogeneity of a fibrous resin increases at the surface, particularly for cast products. Since the insulating part of the fibrous plastic material is particularly on the surface, static charges can collect on the surface. Therefore the required conductivity effect reduces at the surface and deflection drifts occur as described in documents U.S. Pat. No. 4,845,512 and GB-A-2 249 995. Functional surfaces of the parts concerned can be machined to improve the surface homogeneity, but this increases their manufacturing cost.

Furthermore, the use of a volatile liquid in the composition of the ink causes condensation. Parts close to the inkjet gradually become coated with liquid, depending on internal ventilation in the printer, the partial pressures of the various surrounding gases and temperature gradients. This causes conduction phenomena on the walls of the deflection electrodes and a reduction in the space between the jet and the electrodes. A drift in the deflection of the drops is then observed during use of the spraying control system.

In order to overcome this problem, document U.S. Pat. No. 5,001,497 proposes to heat the deflection electrode concerned using an electrical resistance to vaporize the deposited liquid. The use of this type of resistance was criticized in document GB-A-2 249 995 due to the heat released by this resistance and due to the value of the current necessary for it to operate correctly.

One harmful phenomenon in these inkjet print heads is due to the possible interaction between drops in flight. A good spraying control system must have a short drop path to reduce this phenomenon.

Some manufacturers chose not to coat conducting deflection plates with a dielectric material. They include resistances in the deflection plate electricity power supply circuit in order to prevent accidental electrostatic discharges, in order to limit the discharge current in the circuit. Several types of electrical discharges may occur during operation of a printer.

The first type of discharge is given in the case of a voltage applied between two well polished plates. The electrical field is identical everywhere and shock ionization conditions take place uniformly on average. Thermal agitation causes a sudden increase in the current at a given moment that changes from an almost zero value to a gigantic value if there are no resistances in the circuit. The energy stored is used almost entirely within a very short instant depending on the form of the storage condenser, and this form defines the electromagnetic condition of the discharge transient. The dissipated power per unit volume is gigantic and is concentrated very locally. When metal plates are used connected to the high voltage power supply through about three meters of cable, the stored energy can exceed 1 mJ.

In other cases, electrical leaks are particular sources in space (conducting tips, insulation faults, foreign bodies) in which the field which is sufficiently strong locally generates an ion or electron source. The flow from this source is adjusted to a certain extent by means of the created space charge. The result is a stable current probably satisfying Langmuir's law, and current fluctuations then occur with the current remaining finite. This second discharge case causes variations in the deflection field, and also variations in the charge on the drop. This reduces the precision of inkjet printers.

A known means of solving problems related to the first type of discharge is to place protection resistances, partly for safety of persons and the equipment (the electrode coating is subject to electro-erosion in the long term), and to eliminate the fire risk. These resistances must be located such that they compartmentalize the stored electrical energy. In particular, the energy stored in risk areas such as the deflection space must be reduced. The energy stored in this space is frequently of the order of 20 $\mu$J.

BRIEF SUMMARY OF THE INVENTION

A first purpose of this invention is to reduce the number of mechanical and electrical components in a liquid spraying control system.

A second purpose of this invention is to eliminate discontinuities on internal surfaces of the liquid spraying control system.

A third purpose of this invention is to shorten the path of drops subject to interactions between each other in the liquid spraying control system.

A fourth purpose of this invention is to integrate the electrical circuits necessary for the liquid spraying control system into a single component.

These purposes are achieved by this invention which relates to a spraying control system for an electrically conducting liquid emitted in the form of a pressurized jet through at least one nozzle, comprising means of separating the liquid jet into drops, means of electrically charging the said drops and means of applying an electrical deflection field to the said charged drops, comprising:

- two elements each with a continuous surface, laid out such that the continuous surfaces are facing each other and define a space between them in which the pressurized jet is emitted through the said nozzle, the said elements including means of continuously setting up potentials on the said continuous surfaces to obtain the said electrical charge of the drops and the said electrical deflection field,
- electronic control means for the said potentials and means of checking the intensity of electrical currents that can circulate on the said continuous surfaces.

Advantageously, the continuous surface of the first element is conducting and has electrical connection means to one of the said potentials, the continuous surface of the second element is composed of one face of an insulating support, this face being equipped with conducting tracks with means of making electrical connections at potentials chosen among the said potentials, with a resistive coating with a resistance per square mm between 5 MΩ and 100 MΩ, extending continuously over the said face.

The continuous surface of the first element may also be covered with a continuous resistive coating.

The first and the second elements may also be provided with means of separating the liquid jet into drops and inclining the jet. These means are used to apply an electrical field on the jet and may include resistive means and capacitive means. In this case, the resistive means are advantageously composed of a part of the resistive coating which preferably comprises discontinuities in some portions in order to increase the jet separation efficiency. Capacitive means may consist of the said coating supported by an insulating layer, this insulating layer acting as a dielectric and being supported by conducting means supported by the said insulating support.

BRIEF DESCRIPTION OF THE DRAWINGS

The invention will be better understood and other details and particular features will become clear after reading the following description, given as a nonrestrictive example accompanied by the attached drawings among which.

DETAILED DESCRIPTION OF THE INVENTION

As an example, the rest of the description will be applicable to an ink spraying control system for a continuous jet print head. The ink may be emitted in one or several jets that are separated into drops. The electrically charged ink drops are then deflected by an electrical field to either enter an ink recovery and recycling circuit, or a support on which the ink is to be deposited.

Figure 1:
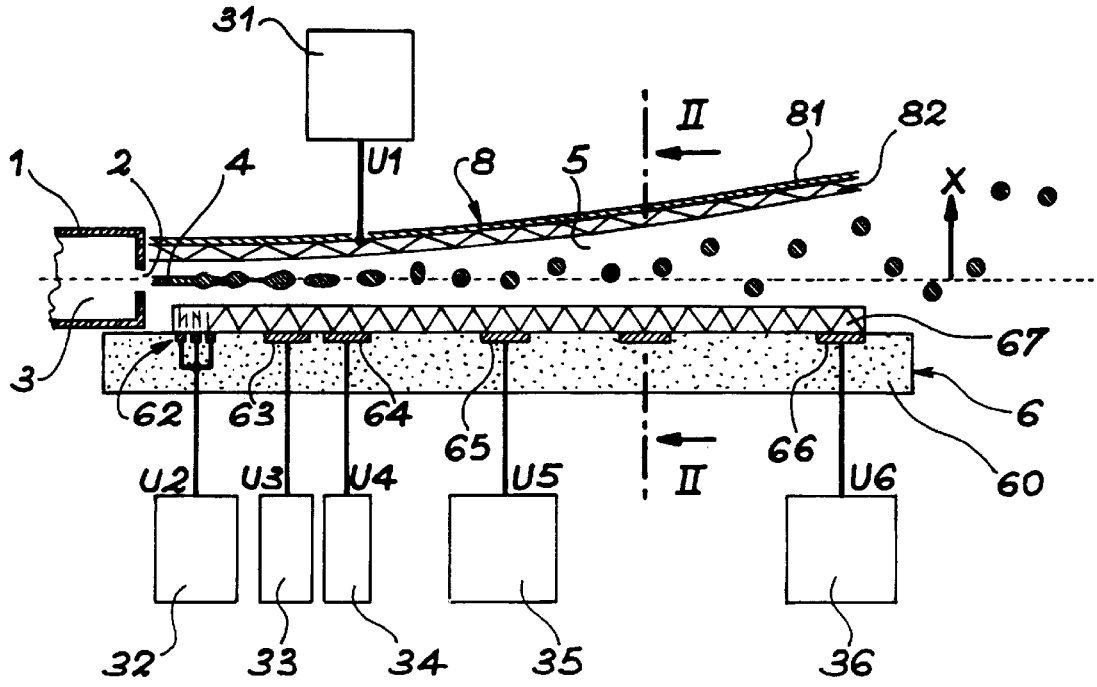
FIG. 1 shows a longitudinal view of the mechanical part of an ink spraying control system according to this invention.
Figure 2:
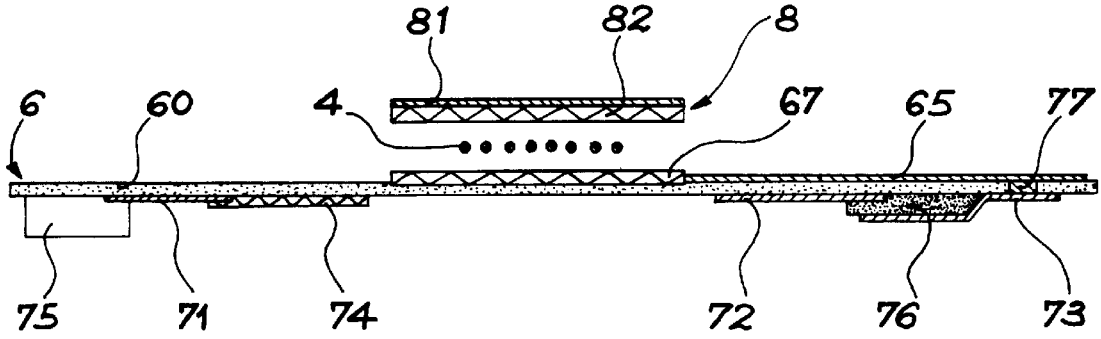
FIG. 2 is a view along plane II—II in FIG. 1.

As shown in FIG. 1, the ink 3 contained in cavity 1 is emitted under pressure through nozzle 2. The inkjet 4 emitted by nozzle 2 is sprayed into the space 5 defined by the continuous surfaces presented by the two elements 6 and 8, these surfaces facing each other. Several inkjets such as jet 4, may be emitted by several nozzles between these continuous surfaces, as shown in FIG. 2.

Element 6 comprises a plane insulating support 60, for example made of alumina, in which the face adjacent to space 5 supports conducting tracks 62 to 66 and a resistive coating 67. The conducting tracks 62 to 66 electrically connect the resistive coating 67 to voltage generators 32 to 36, to which control potentials $U_2$ to $U_6$ respectively will be applied. Conducting tracks such as 71, 72, 73, resistive coatings such as the resistive coating 74, the dielectric coating 76 and electrical or electronic components such as component 75 (see FIG. 2), may also be fitted on the other face of support 60.

The electrical or electronic components deposited on support 60 may be integrated analog or logical circuits, transistors or diodes, capacitors, or a transformer. They can be used to step up voltages, to make current and voltage measurements, generate the signals necessary for separation of the inkjet (if necessary) and for charging the drops, and for generating power supply voltages.

The electrical links between the two main faces of the support 60 may be made by metallized holes such as metallized hole 77. This is the description of a monolithic element formed in the electrically insulating mass, which is usually used as a support for electronic components. These components perform functions for the input control interface to the liquid spraying electrodes.

In the example described, element 8 comprises a continuous support 81, for example made of alumina or another insulating material covered by a continuous resistive coating 82. A voltage generator 31 supplies a potential $U_1$ to the continuous resistive coating 82. Element 8 can also be composed simply of a metal or another conducting material providing a continuous surface. The voltage generator 31 is then directly connected to the material in this element.

The inkjet 4 used in the spraying control system according to the invention, has an electric potential $U_{jet}$ which will be used as the reference potential to simplify explanations. This inkjet may firstly be provided with a dynamic disturbance depending on the time and causing separation of the jet into drops after a time period, for example by means of a resonator included in the cavity 1. On the other hand, there may be no dynamic disturbance applied to it as it leaves the nozzle, in which case the separation into drops is carried out by the spraying control system according to the invention.

Figure 3:
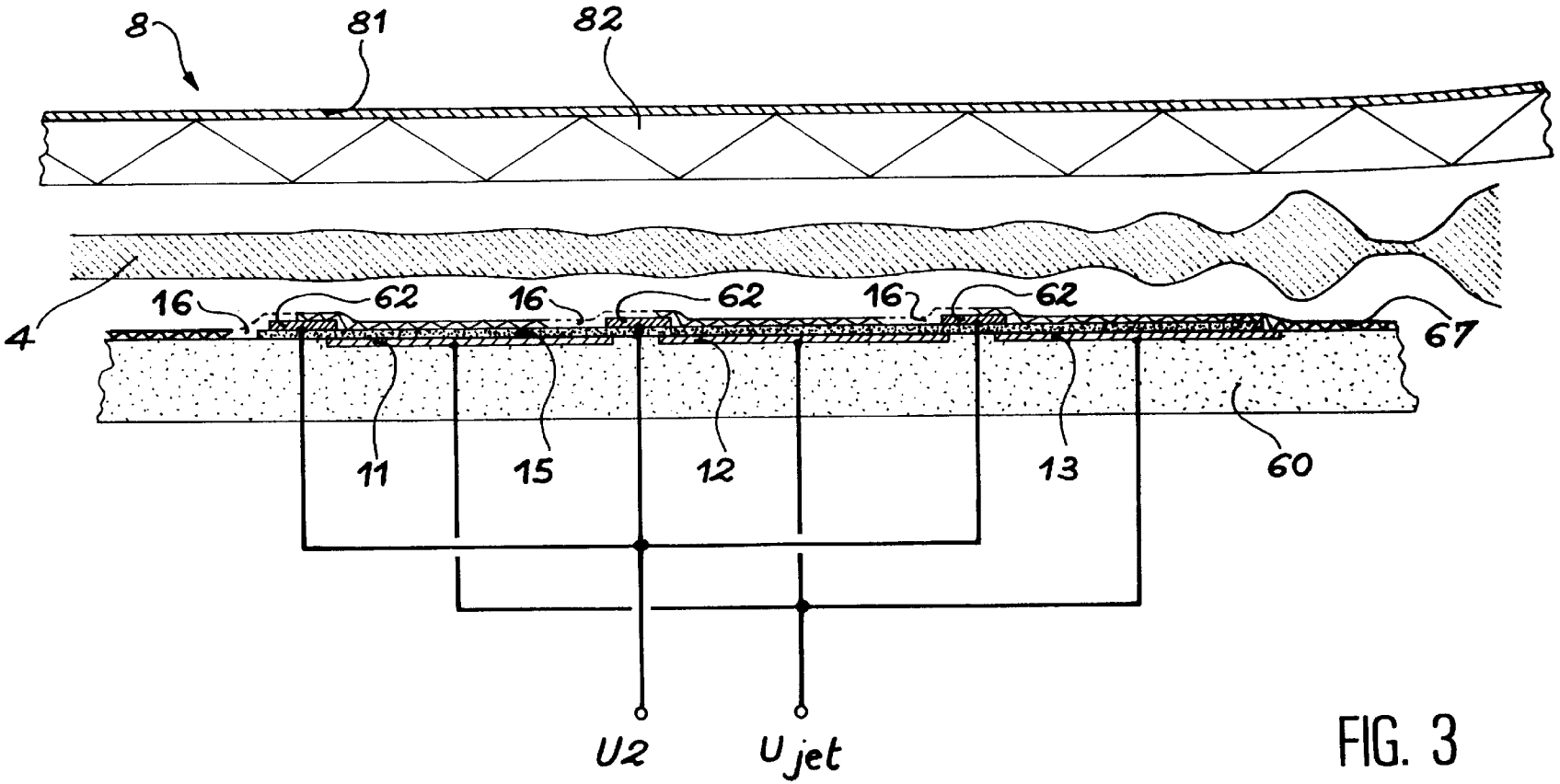
FIG. 3 is an enlarged detailed view of the mechanical part shown in FIG. 1.

We will now describe the manner in which the jet can be separated into drops using the spraying control system according to the invention, with relation to FIG. 3. In the part close to the ink spraying nozzle, the insulating support 60 supports three electrodes 11, 12 and 13 laid out in sequence in the direction of the inkjet and covered with an insulating layer 15. The conducting tracks 62 (see also FIG. 1) are deposited on the insulating layer 15 so as to surround the Electrodes 11 and 12. The resistive coating 67 covers conducting tracks 62 and the insulating layer 15 at the same time. This resistive coating 67 has discontinuities (in other words interruptions) on three small parts 16 at regular intervals, corresponding to the inlet part (jet inlet) of the conducting tracks 62, in order to avoid propagation of the original signal $U_2$ on the coating 67 in the reverse direction of the jet.

The electrodes 11, 12 and 13 are set to potential $U_{jet}$, the electrode 81 is set to potential $U_1$ and the conducting tracks 62 are set to potential $U_2$. At the inlet, two attractive forces derived from potentials $U_2$ and $U_1$ are applied to the inkjet 4. These two forces oppose each other. Their difference produces an inclination of the incident jet that may be constant and/or dynamic if potential $U_2$ is variable. This applies a dynamic disturbance to the jet varying with time causing subsequent separation of the jet into drops. The inclination and disturbance of the jet advancing into the liquid spraying control system are then amplified. Due to the potential $U_2$ set up on the resistive coating 67, the force created by potential $U_2$ varies gradually and is replaced by a force created by the signal $U_3$ than $U_4$ applied to conducting tracks 63 and 64. The dynamic disturbance of potential $U_2$ with time is quickly attenuated by the presence of the insulating layer 15 as will be seen later. The static inclination given firstly by potential $U_2$ then gradually increases according to potential $U_3$. The force derived from potential $U_1$ varies essentially due to the modification of the distance between the jet and the position of the potential $U_1$.

The dynamic disturbance applied by the separation signal reduces the diameter of the jet in some locations under the action of surface forces. The diameter reduces until it drops to zero. This is the point at which separation of the jet, or breakage, occurs. This is the moment at which the electrical charge on the drop formed depending on potentials $U_3$, $U_4$ and $U_1$ associated with the distances between the liquid and these potentials, is tested. In the example described here, the potentials $U_3$ and $U_4$ are equal and represent the charge control signal. This makes the electrical charge of the drop independent from the separation location, within limits.

Since it entered into the system, the jet or drops is (are) continuously deflected under the action of forces generated by the surrounding potentials and charges of the drops and the jet. The charged drops are then directed to a space in which the deflection field remains high and becomes constant with time. They move away from the influence of the charge control supplied by potentials $U_3$ and $U_4$. The free space between the potentials of the resistive coating 67 and $U_1$ increases, depending on the needs of the printer to be defined. In practice, this means that the drops do not approach the internal surfaces of the system in an unstable manner. The potentials applied to the resistive coating 67 are defined in advance to guarantee operation without electrical discharges and without any risk to cohesion of the drops. Thus, the paths of the drops obtained by the separation signal at the output from the system according to the invention, are controlled by the charge signal powering potentials $U_3$ and $U_4$, and by the inclination signal powering potential $U_2$.

The various static potentials used in the ink spraying control system according to the invention are obtained by electrical circuits known to an expert in this subject. For guidance, a chopping transistor could be used defining a low voltage potential at the primary terminals of a voltage step-up transformer with several secondaries. Diodes connected to the transformer secondaries output positive and negative rectified voltages with the same amplitude. This provides the power supply voltages for the two amplifiers that output potentials $U_2$, $U_3$ and $U_4$. Potential $U_1$ is obtained analogically. Potentials $U_5$ and $U_6$ may be obtained by means of multiplying cells formed from diodes and capacitors and which can give multiples of the peak-to-peak voltage appearing at a secondary of the transformer.

A control device is provided in order to control the precision and verify operation of the system. Voltage measurements representing the resultant of the voltage behavior in the X deflection are input into this control device. Thus, the measurements used to modify either the low voltage supplying the assembly, or the chopper rate, or the information sent to obtain potentials $U_3$, $U_4$ or $U_2$. This gives a deflection X that does not vary with variations in the circuits used to obtain electrical voltages.

Due to the use of a resistive coating in the part of the system according to the invention corresponding to deflection plates according to known art, there is no stored electrostatic energy that could cause a sudden discharge in this part. The protection resistances used in some devices according to known art are eliminated. The use of resistive coatings in the system according to the invention, and the existence of parasite currents, do not modify the deflection of the drops considering the means used above to control the precision.

In this invention, a variable air thickness is used between the jet inlet and the drop outlet. The increase in the electrical field possible at short distances is used. This is well known and is illustrated by Paschen's curve defining the voltage resulting in uncontrollable ionization in a pressurized gas between two conducting plates separated by a given distance. This, combined with the real deflection of the charged drops, is used to define the particular curvature of the surface to be generated. The reduction in the free space produces a substantial reduction in the amplitude of the control voltages and a higher deflection efficiency. This invention reduces the voltages used to 2300 V, compared with a conventional design in which 8000 V is necessary.

Another advantage related to the short distances is due to the reduction in the "historic charge". This is due to the influence of the previously charged drop on the charge acquired by the drop leaving the jet. The value of the historic charge may be given by the coefficient a in the charge transfer formula:

$$q(n)=-Ce[v(n)-a\cdot v(n-1)- \ldots ]$$

q(n) sequence of drop charges,

Ce capacitance between the drop and the charging electrode, v(n) sequence of drop charge voltages.

As shown in the formula, the charge can also be expressed as a function of the current voltage of the charging electrode and the voltage at the time that the previous charge was formed. The value of a is given essentially by the ratio between the capacitance between two drops in flight and Ce. In this case, the distance between the drop and the electrode is smaller. Ce increases and thus a reduces. Creation of the charge on the drops becomes less sensitive to this phenomenon.

Small ink deposits inside the spraying system are inevitable when a printer is switched on, even satisfactorily. There is also a risk of more serious dysfunctions if the liquid is accidentally deposited on the resistive coating or on the few locations at which insulation appears between two surface conductors.

Figure 4:
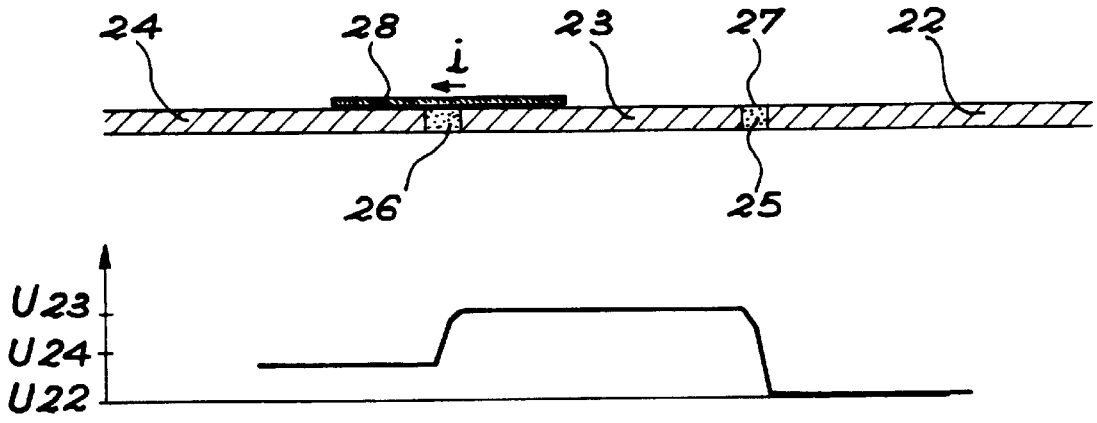
FIG. 4 is a diagram showing the variation of an electrical potential along a surface of an ink spraying device according to prior art.

In prior art, as shown in FIG. 4, an ink deposit generates a disturbing current that passes through the ink deposit. The diagram of the potentials U is compared with the set of electrodes 22, 23 and 24 at potentials $U_{22}$, $U_{23}$ and $U_{24}$ respectively and separated by insulating parts 25 and 26. The surface 27 of the insulating part 25 is easily polluted by parasite electrical charges. If there is an ink deposit 28 between electrodes 23 and 24, a disturbing current i will circulate in the ink deposit above the insulating part 26. The result is the potentials diagram indicated with potential variations corresponding to intense electrical fields, particularly for the insulating part 25. The potentials and currents are then modified and measures are used to alert the control device. Depending on predefined criteria, the system can decide on control modifications or it can periodically close the chopper. It is then possible to wait for the ink to dry (depending on the ink type) and for the resistance of the parasite deposit to change, and then to restart the chopper for a new measurement of the disturbance.

Figure 5:
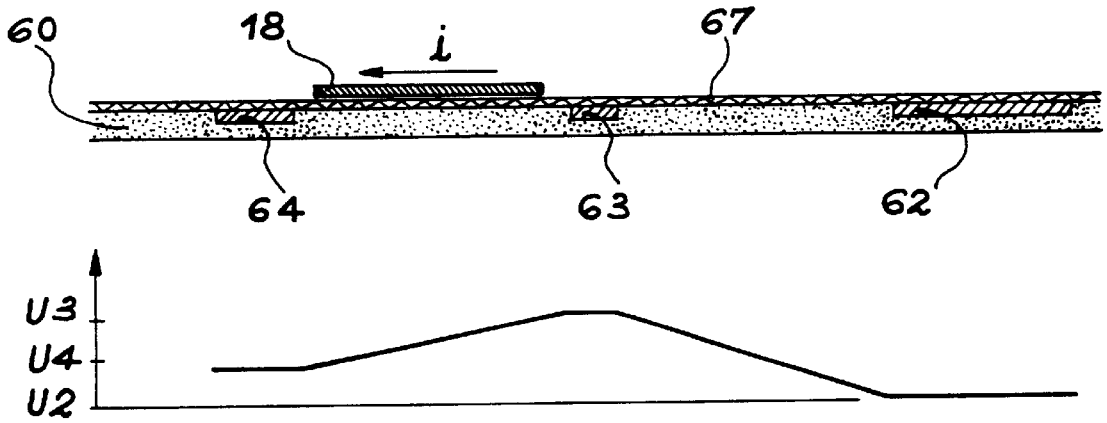
FIG. 5 is a diagram showing the variation of an electrical potential along a surface of an ink spraying device according to the invention.

According to this invention, the ink can only reach a very small proportion of the free surface of the insulation. This is shown in FIG. 5 that is also based on the principle according to the invention; presence of an insulating support 60 supporting contacting tracks 62, 63 and 64 and a continuous resistive coating 67. The conducting tracks 62, 63 and 64 are at potentials $U_2$, $U_3$ and $U_4$ respectively. The presence of an ink deposit 18 between the conducting tracks 63 and 64 causes circulation of a low disturbing current i between tracks 63 and 64. The resistive coating 67 is used to define and reduce the electrical field on the insulation. Thus, the potential drop between the electrodes is organized. The associated potentials diagram clearly shows that the surface electrical field between the conducting tracks is low.

The insulation is no longer accessible to the free space static field, charges escape along the surface without having the time to disturb deflection of the liquid.

This principle is used to define continuous surface potentials intermediate between the potentials imposed by the conducting tracks, as can be seen in FIG. 5. A minor deposit results in a lower disturbing current, and if it is sufficiently small it will not degrade the precision of the printer, or generate a major alert to the control device.

The resistive coating deposited on the insulating support 60, and possibly on electrode 81, may have a resistance per square mm of 5 MΩ to 100 MΩ.

The ink used by inkjet printers comprises a volatile liquid that creates condensation, particularly on surfaces close to the inkjet. Surfaces close to the inkjet in printers according to prior art gradually become coated with liquid, as a function of the internal ventilation, partial pressures of the various gases and temperature gradients, thus causing conduction on walls. There is then a drift in the deflection of the drops.

In the case of this invention, this makes it necessary to define a range of values of the resistance per square mm of the resistive coating. The use of this type of coating can advantageously provide the required surface potential and local warming of this surface. Thus, surfaces close to the inkjet can be heated moderately by means of the potential differences used to control the ink movement. A sufficient dissipation power can be defined to increase the surfaces temperature to about 1 degree above the ink temperature. The resistance per square mm can be defined firstly so that dysfunctions related to the disturbance of electrical magnitudes during parasite ink deposits can be detected. It also provides paths for dissipation of heat generated in the resistive coating and nearby electrical components.

The process according to the invention uses a continuous surface common to functions between the jet inlet and the drop outlet. This reduces or even eliminates local increases in the electrical field due to the use of small radii of curvature. Thus, it is possible to more finely follow discharge limits restricting operation and increase the deflection efficiency. The second type of discharge regulated by Langmuir's law described above can thus be eliminated. In the system according to the invention, the potentials of the separation, charge and deflection functions are generated continuously on a continuous surface to control the surface interface electrical field between the functions.

The dimension along the deflection axis begins at the jet inlet with values of the order of several jet diameters. The limits of the electrical fields are increased due to the small dimensions used. The electrical fields according to this invention are greater than the value of 1.5 MV/m used in conventional printers. Values of 6 MV/m can be reached. Limiting factors are due to the unbalance in the liquid surface due to the electrical pressure in opposition to the surface pressure. The necessary useful length of liquid paths may be reduced for the same required deflection result.

Much lower voltages can be used, as described above. Thus, the potentials between the three functions are reduced, and the distances necessary to form interfaces or "safety distances" between functions are also reduced.

A large reduction in the global length of the drop path is obtained. The drop transit time is thus reduced. Pulses given by interaction forces are reduced in the same manner.

The list of potentials around the inkjet is as follows, starting from the ink emission nozzle (see FIGS. 1 and 3):

$U_{jet}$, $U_1$, $U_2$, $U_3$ and $U_4$: predominantly variable and low potentials controlling the jet path and the charge of the drop, $U_5$ and $U_6$: predominantly constant and high potentials, amplifying the initial trajectory of the drop.

The various manners of controlling potentials and their consequences can be described, starting from these potentials. It will be assumed that the emitted inkjet is closer to the electrode with potential $U_1$ than to the element with several potentials $U_2$ to $U_6$.

According to a first control mode, $U_{jet}=0$, $U_1=0$, $U_2=0$, $U_3=U_4$, $U_5=-400V$ and $U_6=-1200V$. $U_4$ is the control signal tested at the time of the break. For a voltage $U_4$ equal to +100 V, the drop is negatively charged and follows a path giving a positive X. The drop passes along the limit of the upper surface. For a voltage $U_4$ equal to −350 V, the drop is positively charged and follows a path giving a negative X. The drop passes along the lower surface limit.

According to a second control mode, $U_{jet}=0$, $U_2=0$, $U_3=-300V$, $U_4=-350V$, $U_5=-400V$ and $U_6=-1000V$. $U_1$ is the control signal tested at the time of the break. For a voltage $U_1$ equal to +300 V, the drop is negatively charged and follows a path giving a positive X. The drop passes along the limit of the upper surface. For a voltage $U_1$ equal to −50 V, the drop is positively charged and follows a path giving a negative X. The drop passes along the lower surface limit.

According to a third control mode, $U_1=200V$, $U_2=0$, $U_3=-300V$, $U_4=-350V$, $U_5=-400V$ and $U_6=-1000V$. $U_{jet}$ is the control signal tested at the time of the break. For a voltage $U_{jet}$ equal to −50 V, the drop is negatively charged and follows a path giving a positive X. The drop passes along the limit of the upper surface. For a voltage $U_{jet}$ equal to +200 V, the drop is positively charged and follows a path giving a negative X. The drop passes along the lower surface limit.

Obviously, other combinations are possible, particularly if all voltages expressed above are multiplied by −1 and if the proximity assumption between the jet and the potential $U_1$ are modified. The most characteristic combinations are mentioned above. This is guided by the determination of the charge picked up by the drop. A practically constant field is then applied to the charged drop.

The first control mode gives the preferred combination adaptable to the multijet. Jet potentials and $U_1$, $U_2$, $U_5$, $U_6$ are common to the different jets. The control voltage has a comparatively higher excursion.

The second control mode gives the preferred combination, adaptable to the single jet if the simplicity of potential $U_1$ is to be kept. The equipotential $U_1$ can be replaced by a second monolithic circuit. This circuit applies a specific charge voltage like potentials $U_3$, $U_4$, before each break. A constant potential enveloping the charge commands is applied to the rest of the surface.

The third control mode gives a variant adaptable to the single jet. The jet potential is used as the drop charge control potential. The control voltage has a smaller relative excursion. The embodiment is simple, the nozzle being at the control potential. The nozzle ink supply passes through an insulating tube. For example, if the length of the insulating tube is 0.5 m, its internal cross-section is 2 $mm^2$ and if the resistivity of the ink is 8 Ω.m, the control load resistance is then equal to 2 MΩ, which gives a low disturbance for the charge control generator.

The static value of the potential $U_2$ can be used to modify the inclination of the incident jet and/or dynamically deflect the jet and/or propagate a disturbance providing liquid separation information. The continuous jet deflection principle is used as described in patents U.S. Pat. No. 5,001,497 and U.S. Pat. No. 5,070,341. This is a means of subsequently deflecting portions of liquid with no electrical charge. In the process according to the invention, most of the deflection is the result of the force applied to the charged drop. The static potential $U_2$ is a means of adjustment to compensate for jet alignment errors. Means of manufacturing the control electrode and the electrical behavior in this invention are particularly beneficial.

Returning to FIG. 3, the definition of the resistive, conducting and insulating deposits define a propagation of the potential $U_2(t)$ in the direction of movement of the jet. Thus the dynamic potential of the resistive deposit, very similar to $U_2$ in amplitude and in phase, is present over a wide range depending on the required drop formation frequency.

The extent of the signal penetration is given by the formula $(cd.\omega.rd)^{-1/2}$ for an amplitude exceeding half of the dynamic signal and for a phase of less than 0.2 π*radians. In this formula:

cd is the distributed capacitance between the resistive coating and the conducting deposit at potential $U_{jet}$ in F/m, given by the insulating layer 15, rd is the distributed resistance of the resistive coating in Ω/m, ω is the separation pulse.

The value of cd is of the order of 150 nF/m and the value of rd is of the order of 2.5 GΩ/m. At a frequency of 100 kHz, a penetration range of 78 μm is obtained.

Under steady state conditions (with zero pulse), the entire resistive coating is at a static potential $U_2$, which can give a large static deflection to regulate the jet inclination.

At very high frequencies, the equivalent dynamic potential width of the electrode is the width of the conductor at potential $U_2$. This width is defined to give the maximum separation For the highest drop formation frequency, at least for the smallest distance between two future consecutive drops.

In order to increase the separation efficiency, it is useful to create discontinuities on the upstream side of conducting deposits at potential $U_2$. Thus on the downstream side of these deposits, the signal $U_2(t)$ on the resistive coating is retarded, and thus the peaks of this signal accompany the liquid in the jet. This phenomenon cannot occur in the direction opposite to the direction of the jet, and the signal on the resistive deposit on the upstream side quickly reduces the separation efficiency. Several sequences associated with conductors at potential $U_2$ are provided at a spacing of one or several distances between two drops. This separation principle enables efficient stimulation for different ranges of drop formation frequencies.

Figure 6:
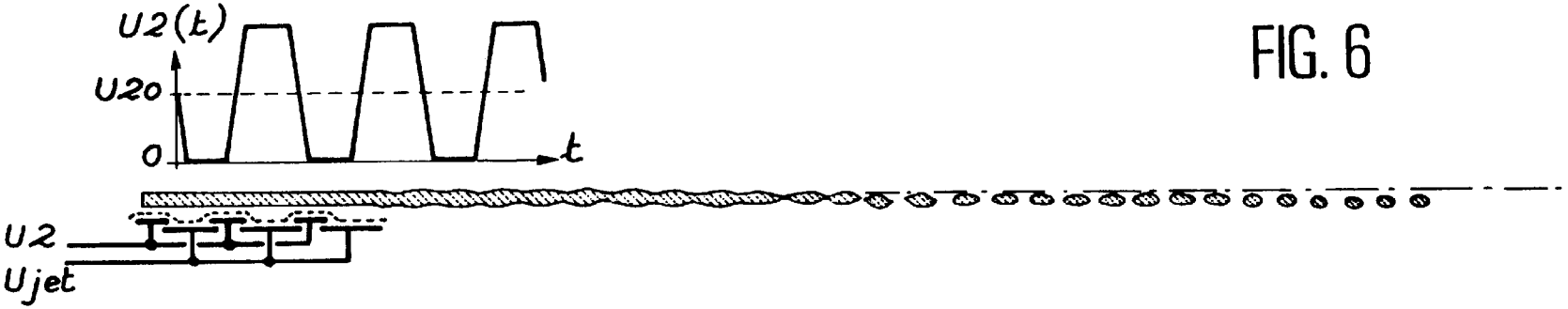
FIGS. 6 and 7 are explanatory diagrams showing two methods of controlling dynamic stimulation of the inkjet.

Two modes of controlling dynamic stimulation of the jet will be described. The first is similar to the process described in patent U.S. Pat. No. 4,220,958. Its principle is to use a "pump electrode" close to the fluid column connected to an electrical energy source to set up a variable electrical field developing a normal force on the fluid column, to provoke the formation of drops with an approximately constant spacing. As shown in FIG. 6, the length of an electrode to apply potential $U_2(t)$ is about half the spacing between drops. The period of the voltage $U_2(t)$ is the period at which drops are formed.

According to this invention, the effective length of the electrode that sets up a variable electrical field to develop a normal force on the jet is also of the order of half the space between drops. However, this effective electrode length is achieved by summating a fixed conducting electrode to the random length related to propagation of the variable signal $U_2$ on the resistive deposit coupled with the capacitive deposit.

With the process according to the invention, the effective length of the electrode setting up the variable electrical field on a jet, can be adjusted to a certain extent. For the same electrode construction, the variation of the effective length of the electrode as a function of the frequency of the signal $U_2(t)$ is a means of effectively stimulating a wider frequency range.

Patent U.S. Pat. No. 4,220,958, and patent U.S. Pat. No. 4,658,269, only describe a symmetric aspect of normal forces around the jet. A second mode of controlling dynamic stimulation of the jet is described in patent U.S. Pat. No. 5,001,497. According to this patent, the jet is deflected due to an asymmetric aspect of the dielectric force on the jet. The jet then reaches the surface of the collector-section to select liquid "sausages" to be printed as opposed to the liquid to be retrieved.

Figure 7:
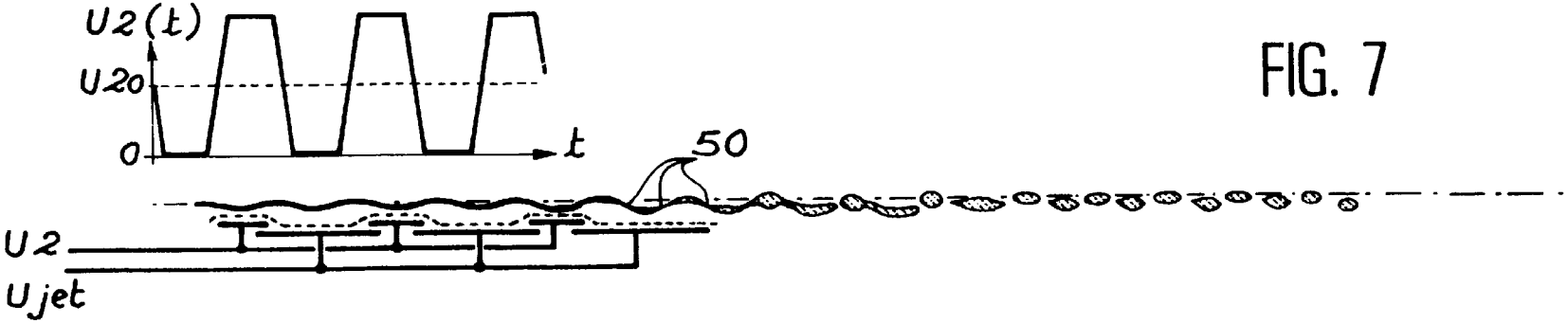

According to this invention, the jet is deflected by the action of the electrical field emitted by the resistive electrode to stretch the jet in inflection points along its trajectory. The surface tension follows the liquid flow at these inflection points to subsequently form the future break points between the drops. The advantage of this control mode is that it defines dimensions of the electrode twice as large in the direction along which the jet advances. The dimension suggested in patent U.S. Pat. No. 4,220,958 was half a drop space for its electrode, whereas this jet attack mode requires one drop space. As shown in FIG. 7, the period of the voltage $U_2(t)$ is then twice the drop formation period. Reference 50 shows inflection points along the inkjet trajectory.

The lithography technique used to make conducting and resistive electrodes can then be less precise. This provides an advantage since the dimension of the width of the conducting track needs to be smaller than the spacing between drops. A half space can be chosen between drops for the width of the conducting track, the resistive track then being used to transmit the potential $U_2$.

The spacing between drops is then 250 $\mu$m for an inkjet separated at 80 kHz and at a speed of 20 m/s. The dimension of the track width is then 125 $\mu$m. This value is easy to obtain using silk screen printing techniques for the thick layer type conducting ink deposits used in the electronic industry.

What is claimed is:

1. Spraying control system for an electrically conducting liquid emitted in the form of a pressurized jet through at least one nozzle, comprising means for separating the liquid jet into drops, means for electrically charging said drops, means for applying an electrical deflection field to said charged drops, a first and a second monolithic element each with a continuous surface, laid out such that the continuous surfaces are facing each other and define a space between them in which the pressurized jet is emitted through said at least one nozzle, said first and second monolithic elements including conducting means with means of making electrical connections to electrical potentials used to set up continuous potentials on said continuous surfaces to obtain said electrical charge of the drops and said electrical deflection field, and electronic control means for said potentials, wherein the continuous surface of the first monolithic element is conducting and has electrical connection means to one of said potentials, and the continuous surface of the second monolithic element is composed of one face of an insulating support, this face being equipped with conducting tracks with means for making electrical connections at potentials chosen among said potentials, with a resistive coating with a resistance per square mm between 5 MΩ and 100 MΩ, extending continuously over said face, the system further comprising means for checking intensities of electrical currents that can circulate on said continuous surfaces.

2. Spraying control system according to claim 1, wherein the continuous surface of the first element is also covered with a continuous resistive coating.

3. Spraying control system according to claim 1, wherein said first and second monolithic elements are also provided with said means for separating the liquid jet into drops and means to incline the jet.

4. Spraying control system according to claim 3 wherein the means used to separate and incline said jet are means that can apply an electrical field to said jet.

5. Spraying control system according to claim 4, wherein the means used to apply an electrical field to said jet include resistive and capacitive means for applying said electrical field.

6. Spraying control system according to claim 5, wherein the capacitive means comprise said resistive coating, said resistive coating being supported by an insulating layer, this insulating layer acting as a dielectric and being supported by conducting means supported by said insulating support.

7. Spraying control system according to claim 5, wherein the resistive means are composed of part of the resistive coating.

8. Spraying control system according to claim 1, wherein the first or the second monolithic element supports at least one of the electronic control and checking means.

9. Spraying control system according to claim 8, wherein the monolithic element supporting at least one of the electronic control and checking means comprises an insulating support identical to the electronic components support.

10. An inkjet printer comprising:

a nozzle for emitting electrically conducting liquid in the form of a pressurized jet and the spraying control system according to any one of the previous claims.

* * * * *